US005755982A

United States Patent [19]

Strickland et al.

[11] Patent Number: 5,755,982

[45] Date of Patent: May 26, 1998

[54] CONCRETE CASTING SYSTEM

[75] Inventors: James K. Strickland, Jacksonville; Arthur Sherrer, Jr., Ponte Vedra Beach; Robert L. Murphy, Jacksonville, all of Fla.

[73] Assignee: Strickland Industries, Inc., Jacksonville, Fla.

[21] Appl. No.: 337,005

[22] Filed: Nov. 7, 1994

[51] Int. Cl.[6] ..... B28B 7/30

[52] U.S. Cl. ..... 249/74; 249/144; 249/152; 249/161; 249/168

[58] Field of Search ..... 249/27, 63, 74, 249/144, 152, 161, 168, 169, 178, 180

[56] References Cited

U.S. PATENT DOCUMENTS

| | | | |
|---|---|---|---|
| 2,827,683 | 3/1958 | Benart et al. . | |
| 3,205,552 | 9/1965 | Johnson et al. | 249/152 |
| 3,476,351 | 11/1969 | Burdett . | |
| 3,570,802 | 3/1971 | Miller . | |
| 3,680,824 | 8/1972 | Kesting . | |
| 3,822,853 | 7/1974 | Shelley . | |
| 3,841,596 | 10/1974 | Cull . | |
| 3,844,526 | 10/1974 | McCracken . | |
| 3,853,452 | 12/1974 | Delmonte . | |
| 3,934,808 | 1/1976 | Aizawa . | |
| 3,989,439 | 11/1976 | Schmitzberger . | |
| 4,088,296 | 5/1978 | Armas . | |
| 4,252,291 | 2/1981 | Armas . | |
| 4,252,292 | 2/1981 | Armas . | |
| 4,447,035 | 5/1984 | Ivey et al. . | |
| 4,519,570 | 5/1985 | Strickland et al. . | |
| 4,570,896 | 2/1986 | Strickland et al. . | |
| 4,614,326 | 9/1986 | Strickland et al. . | |
| 4,664,173 | 5/1987 | Wolniak . | |
| 4,679,762 | 7/1987 | Lee | 249/27 |
| 4,729,541 | 3/1988 | Maier . | |
| 4,890,999 | 1/1990 | Del Monte . | |
| 5,058,855 | 10/1991 | Ward . | |
| 5,169,652 | 12/1992 | Del Monte | 249/27 |
| 5,230,907 | 7/1993 | Strickland . | |
| 5,338,498 | 8/1994 | Lefebvre | 249/27 |

FOREIGN PATENT DOCUMENTS

| | | |
|---|---|---|
| 8 333 | 2/1908 | France . |
| 1 436 683 | 12/1966 | France . |
| 2 059 864 | 6/1971 | France . |

*Primary Examiner*—James P. Mackey
*Attorney, Agent, or Firm*—Banner & Witcoff, Ltd.

[57] ABSTRACT

A mold system for casting five-sided, monolithic, seamless concrete products comprises an outside jacket, an inside mold core complete with base, and a movable pallet to aid stripping. The outside jacket preferably includes two L-shaped panel members arranged in a rectangular configuration which are supported for movement between open and closed positions by a pair of base-mounted corner actuators extending from the fixed base to the apex of each panel member. The panel members are also linked to one another by a series of actuators along each of the adjoining two corners of the jacket. The inside core includes four interior panels linked by four inside retractable corners. A minimum of two series of actuators also span the middle portion of the inside core. These middle actuators in conjunction with the actuators in the corner devices function to expand and contract the entire inside mold core. A plurality of base supported actuators are fastened to the inside core. These base actuators each have an adjustable connector rod for selectively engaging the outside panel members against the pallet for supplying additional pressure between the inside core and outside panel members to reinforce the system during pouring of the concrete and subsequent hardening. The actuators on the movable pallet also aid in releasing the concrete product after hardening.

21 Claims, 11 Drawing Sheets

CONCRETE CASTING SYSTEM

FIELD OF THE INVENTION

The present invention pertains to an apparatus for integrally casting monolithic concrete structures, and in particular, to an automated apparatus constructed to mold five-sided structures.

BACKGROUND OF THE INVENTION

Molding box-like modular concrete units has previously been achieved by manual and semi-automated systems using removable forms which are assembled for pouring and disassembled for releasing the forms from the cast product.

In some systems, the forms are assembled manually. One example of a manual system is described in U.S. Pat. No. 3,841,596 to Cull. The Cull patent shows an inner core and exterior form which are connected by hangar bars and bolts. Demountable corner forms join interior panels together with a series of clips to form the inner core. Screw jacks are utilized as adjustable stiffening struts between the interior panels and the base.

In other systems, the forms and panels are moved by various automated and manual devices including hydraulic pistons and screw jacks. The following patents exemplify prior art systems for casting modular concrete units.

U.S. Pat. No. 3,680,824 to Kesting discloses a casting system including an interior form and an exterior form. The exterior form is defined by exterior panels which are mounted to scaffolds by pivoting guide links attached to brackets. Likewise, the interior form includes panels which are attached to an inner framework by a plurality of pivoting links. Hydraulic cylinders are provided to move the inner and exterior panels between the casting and release positions.

U.S. Pat. No. 3,822,853 to Shelley discloses a casting system which comprises several embodiments for expanding and contracting an inner core, but which utilizes simple trussed members for the exterior forms. Most of the variations of the inner core feature collapsible L-shaped members which are moved by operation of screw jacks or hydraulic pistons. The Shelley patent also discloses a corner form which is actuated by a screw jack so as to move in concert with the interior panels. The exterior forms are simply rolled along a base.

U.S. Pat. No. 3,853,452 to Delmonte discloses a machine in which a superstructure supports a plurality of interior and exterior wall forming panels and corner panels which are interlocked together. Inner and outer hydraulic cylinders mounted to the superstructure move the interior and exterior panels toward and away from each other.

The prior art systems do not provide an efficient, reliable casting system with sufficient structural integrity to ensure that the forming elements avoid the forming of rough and unsightly seams in the concrete structure. Further, in the prior art, grout (i.e., a cementitious runoff of excess water, member, sand, etc.) tends to seep into and form on the parts of the form and cause the form to thereby resist release of the casting. As can be appreciated, this lack of structural integrity in the forms has been particularly troublesome in the casting of large, monolithic concrete products. Prior systems have not been able to adequately withstand the high pressures associated with casting oversized of concrete products.

SUMMARY OF THE INVENTION

The present invention pertains to a system for casting monolithic, seamless concrete products with interior cavities. The system comprises an outside jacket and an inside mold core each of which is movable between open and closed positions.

In accordance with one aspect of the invention, a plurality of base linking actuators are interconnected between the jacket and mold core to tighten the mold and alleviate leakage along the lower region of the mold. These actuators are preferably fastened to the inside core for movement with the core panels toward and away from the outer jacket. These base linking actuators selectively engage the outside panel members for tightening and releasing the mold. Preferably, the actuators each includes a rotating hook connector for grasping and/or abutting a bracket fixed to an outer panel.

In accordance with another aspect of the present invention, the system includes corner linking actuators which span the joints defined along the corners of the jacket panel members to enhance the structural integrity of the outside jacket. In the preferred construction, the corner linking actuators are mounted to one of the outer panel members for movement therewith and selectively coupled to the adjoining panel.

In accordance with another aspect of the invention, the system includes a lid to effect casting of five sided structures. In this construction, the system further includes a lower pallet for supporting the cast product. The pallet is vertically movable between a casting position and a release position by actuators mounted in the base. Raising of the pallet after hardening of the cast product effects release of the product from the lid.

In accordance with another aspect of the invention, the system comprises a series of fluid cylinders which are cooperatively driven to move the various elements of the mold into and out of an efficient, reliable, strong casting mode which alleviates the problem of undesirable leaking. The system is coordinated to minimize reliance on manual activity.

These and other objects, advantages, and features of the present invention will be more fully understood and appreciated by reference to the written specification and appended drawings.

DETAILED DESCRIPTION OF THE PREFERRED EMBODIMENT

Figure 1:
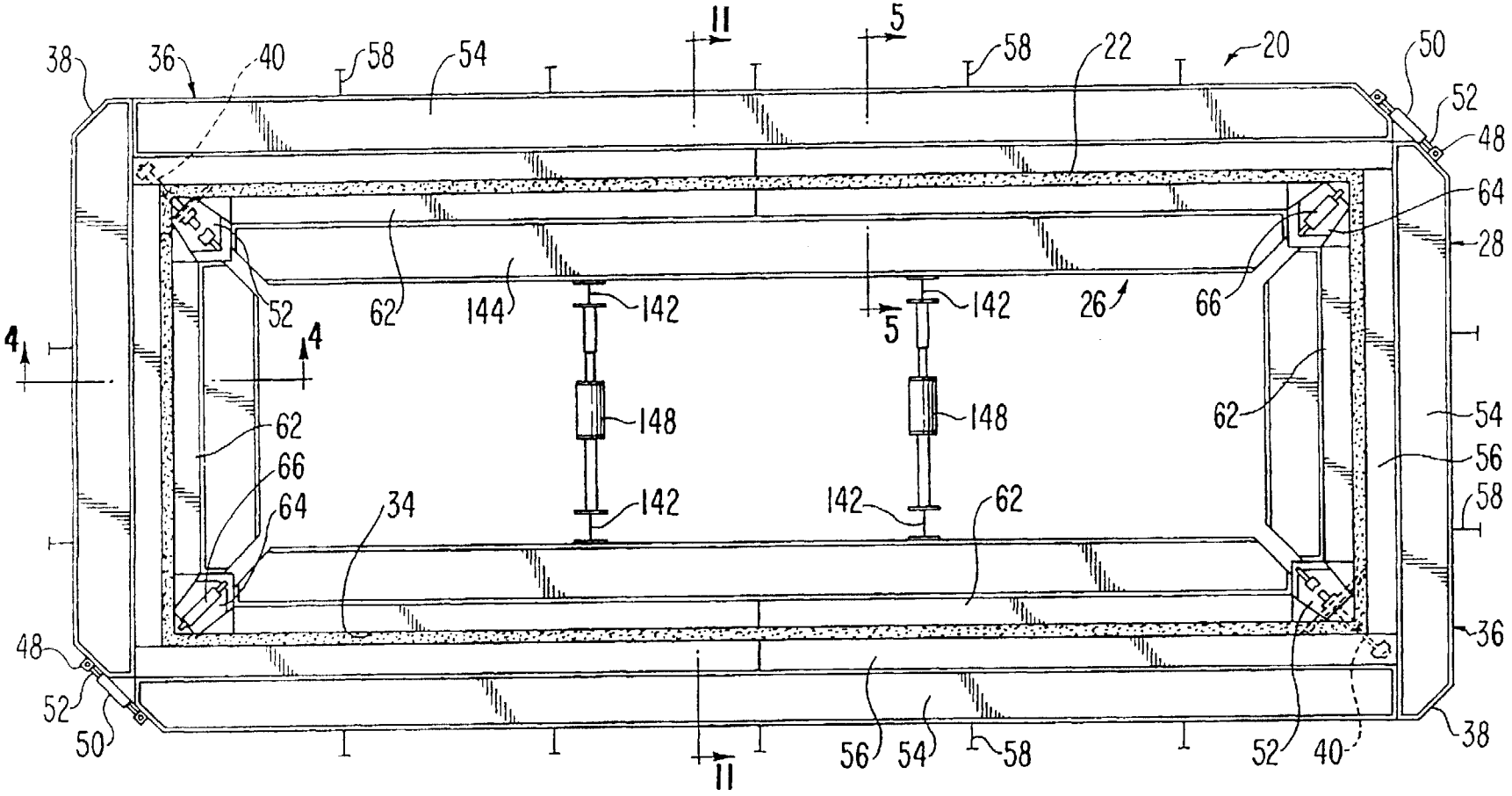
FIG. 1 is a top plan view of the mold system of the present invention with the components in the closed, casting position, shown without the lid.

In the preferred embodiment, a mold system 20 for casting a monolithic concrete product 22 is defined by a base 24, an inside mold core 26, an outside jacket 28 and a pallet 32. Base 24 provides a solid foundation for supporting the internal core of the machine. To ensure a level cast, base 24 includes threaded leveling screws 30. The present system is especially designed for the casting of four or five sided products. The products are cast to have four side walls 23 defining a rectangular shape and possibly a top, or a fifth side. Nonetheless, it will be understood that any desired shape may be produced with accompanying adjustments to the components of the system.

Reference is made throughout the description to a closed casting position and an open release position. The closed casting position refers to the configuration of the system when all of the components are moved to form a mold cavity 34 into which concrete may be poured (FIGS. 1, 4, 5 and 11). The open release position refers to the configuration of the system when the components are moved away from the cast product in order to strip the panels and remove the product from the mold system (FIGS. 2 and 12).

Figure 6:
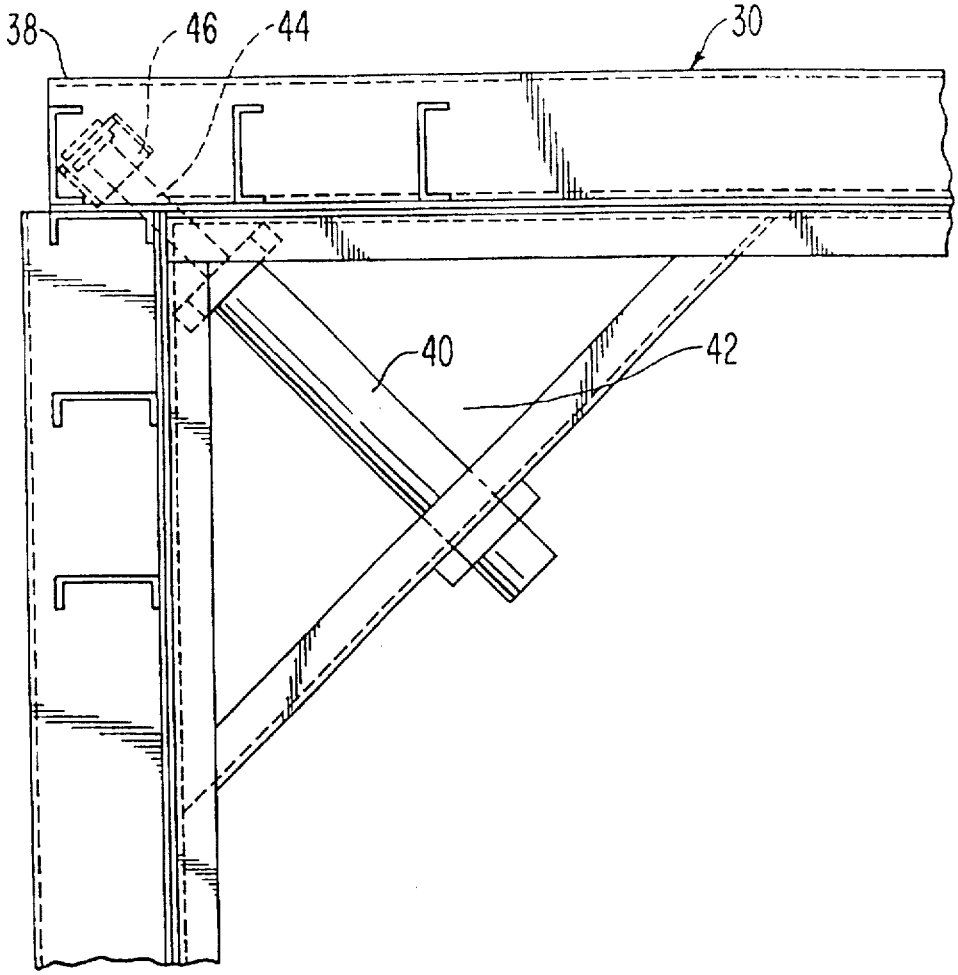
FIG. 6 is a partial cross-sectional top view of the corner jacket cylinder at the base of the system of FIG. 1.
Figure 7:
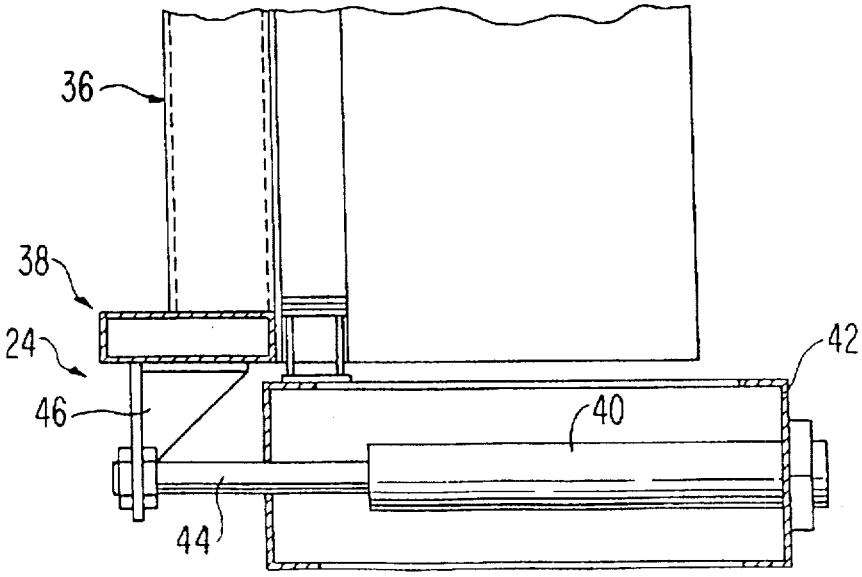
FIG. 7 is a partial cross-sectional side view of the corner jacket cylinder of FIG. 6.

Outside jacket 28 preferably comprises two L-shaped panel members 36 which are arranged in a rectangular configuration. The apexes 38 of panel members 36 are disposed at diagonally opposing corners of outside jacket 28. Panel members 36 are supported on rollers (not shown) for movement along supports 39 between the open and closed positions. A pair of corner base cylinders 40, which are preferably hydraulic, extend from the fixed base 24 to apex 38 of each panel member 36. Corner base cylinders 40 are shown in phantom lines in FIGS. 1 and 2, and best illustrated in FIGS. 6 and 7. Each corner base cylinder 40 is preferably secured on a diagonal to a corner of base 24 and brace 42. Cylinder 40 comprises a piston rod 44 attached to a bracket 46 fixed at apex 38 to a pane member 36. Each panel member 36 is moved from an open release position to a closed casting position, and back, by the reciprocating movement of piston rod 44.

Figure 2:
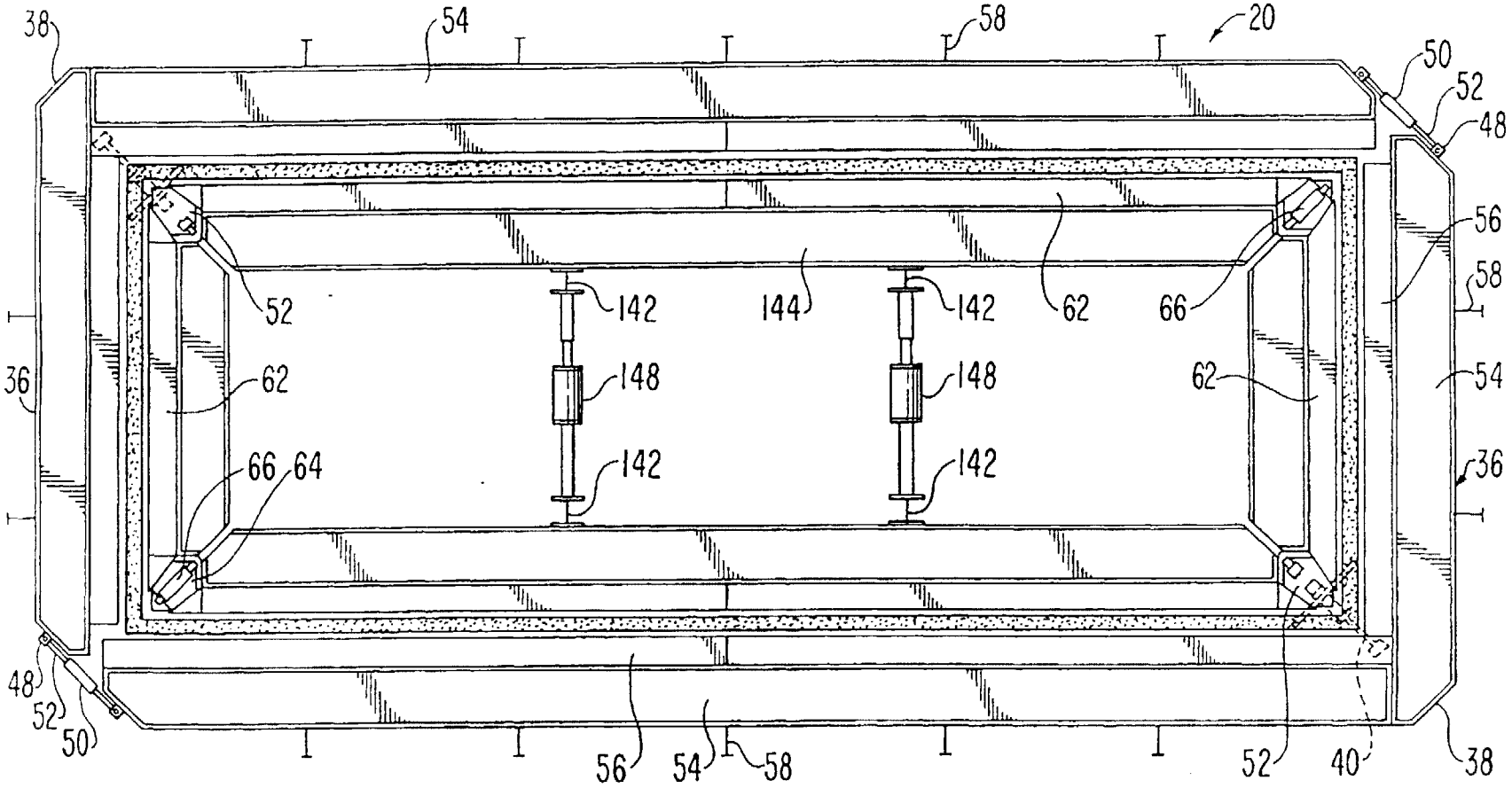
FIG. 2 is a top plan view similar to FIG. 1 but with the components in the open, release position, shown without the lid.

The two remaining diagonally opposing corners of outside jacket 28 are defined by facing portions of panel members 30 (FIGS. 1 and 2). The facing portions are selectively coupled together by a series of vertically spaced hydraulic corner linking cylinders 50. Corner linking cylinders 50, which are preferably hydraulic, are affixed to one of the panel members 36 an d selectively fastened to the other of the panel members by latches 48. Latches 48 preferably comprise a clevis and clevis pin arrangement for easily separating and joining panel members 36. However, other types of latches could be used. Corner pull-up rods 52 of corner linking cylinders 50 each includes a bracket at its free end to attach to a latch 48. Once corner base cylinders 40 have drawn panel members 36 of jacket 28 into the closed position, each of the brackets are latched by insertion of a clevis pin to thereby latch panel members 36 together. The corner linking cylinders 50 are then actuated to tighten the corners against each other. Movement of the panel members due to actuation of the corner linking cylinders is nominal, and in the preferred embodiment ranges between ¼ and ⅛ of an inch. This arrangement effectively prevents any unwanted grout leakage from the outer corners.

The construction of outside jacket 28 (FIG. 5) includes forming panels 56 and an outer framework 57. Framework 57 includes a series of vertically spaced exterior walers 54, and exterior columns 58, both of which are preferably I-beams. Exterior walers 54 are positioned between exterior forming panels 56 and columns 58. Near the base, exterior braces 60 also connect the bottoms of exterior columns 58 to the bottom of exterior forming panels 56.

Figure 3:
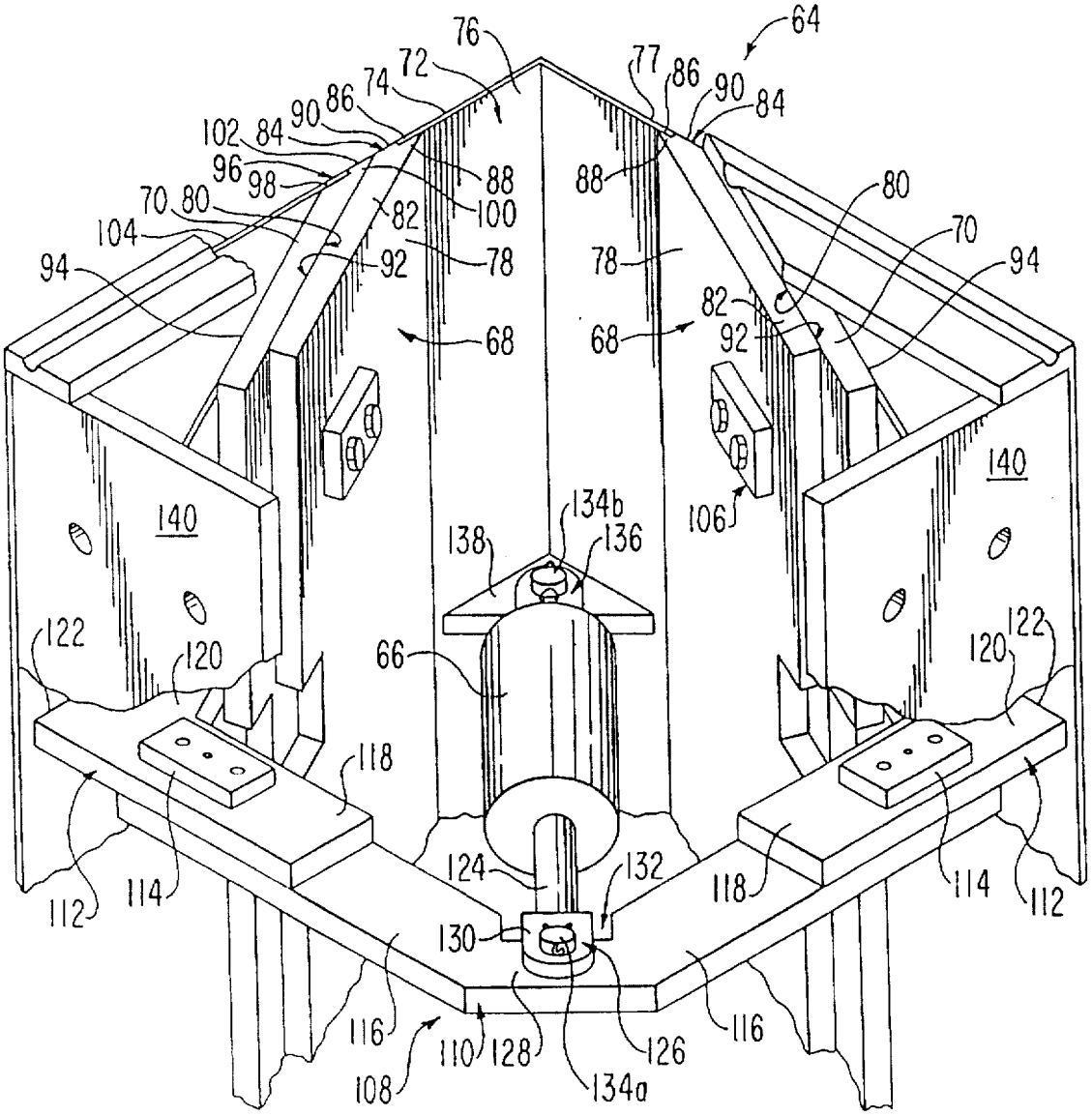
FIG. 3 is a detailed fragmentary, inside perspective view of an inside corner form component of FIG. 1 shown in its expanded position.

Inside core 26 includes a plurality of interior panels 62 linked by four inside corner forms 64, the structures of which are described in detail in U.S. Pat. No. 5,230,907, the entire contents of which are herein incorporated by reference. Reference is made to FIG. 3 which illustrates a single inside corner form 64 in detail. Each corner form 64 is comprised of a plurality of slide plates 68, 70 and a V-shaped corner skin plate 72. All of these plates 68, 70, 72 extend the entire height of corner form 64 and cooperatively interact to form the internal wall surfaces at the corners of inside core 28. Corner skin plate 72 is a V-shaped member having an external face 74 and an internal face 76. Corner skin plate 72 can have other configurations if a different internal corner shape is desired. In any event, corner skin plate 72 is fixedly secured along its marginal edges 77 to a pair of spaced apart, converging inner slide plates 68.

Each inner slide plate 68 defines an internal wall 78 and external wall 80, a top edge 82, and a front wall 84. Front wall 84 is preferably oriented at an angle of approximately 25° to internal wall 78. In addition, front wall 84 is stepped to define a recessed section 86, a shoulder 88, and a molding face 90. Recessed section 86 is adapted to receive marginal edges 77 of corner skin plate 72. Shoulder 88 is dimensioned to equal substantially the thickness of corner skin plate 72 so that external face 74 of skin plate 72 is substantially aligned with molding face 90 to form a relatively smooth, clean inner wall surface for the concrete casting. Corner skin plate 72 is preferably welded into place against recessed section 76 of front wall 84. Each outer slide plate 70 defines an inner wall 92, an outer wall 94, and a front wall 96. Front wall 96 is stepped to include a recessed section 98, a shoulder 100, and a molding face 102. Recessed section 98 and shoulder 100 are adapted to receive the marginal edge of side skin plate 104 which is preferably welded into place.

FIG. 3 shows inside corner form 64 in its expanded position, that is, its closed casting position. External face 74 of corner skin plate 72, molding face 90 of inner slide plate 68, molding face 102 of outer slide plate 70, and side skin plate 104 are all substantially aligned so that a relatively smooth and clean inner concrete wall surface can be formed. In addition, side skin plate 104 will be substantially aligned with the adjacent interior panel 62. To facilitate the requisite expanding and contracting movements of the inside corner form 64, inner and outer slide plates 68, 70 are structured to slide relative to one another. Inner wall 92 of outer slide plate 70 is in abutting relation with outer wall 80 of inner slide plate 68. The engaged slide plates 68, 70 are coupled together by a rectangular slide lug received in slots (not shown) in slide plates 68, 70 for ensuring alignment of the plate members and limiting the relative sliding movement between the two plates.

At least one driving assembly 108 is provided to control and actuate the movement of slide plates 68, 70. Preferably, a series of driving assemblies will be secured to each set of slide plates 68, 70 with one driving assembly mounted near the top of plates 68, 70, and one positioned near the bottom thereof, with any necessary number in between. Each driving assembly includes a squaring arm 110, a pair of brackets 1 12, a pair of slide lugs 114 (which are similar to the slide lugs used to between slide plates 68, 70), and an actuator or corner form cylinder 66. Squaring arm 110 is a substantially L-shaped member which comprises a pair of orthogonal legs 116, 118. Coupled to the distal end of each leg 116 is a substantially L-shaped bracket 112 having an arm with two sections 118 and 120. The first section 118 overlies one of the legs 116 of squaring arm 110, and the second section 120 tapers to a distal point (not shown). The outer edge 122 of bracket 112 engages and secures, preferably by welding, side skin plate 104 in place. The inner tapered edge (not shown) of second arm 120 of bracket 112 is secured, again preferably by welding, to the outer wall 94 of outer slide plate 68. As is known in the prior art, brackets 112 are secured to securing plates 140 which are bolted to complementary securing plates (not shown) of interior panels 62. The overlapping portions of bracket 112 and squaring arm 110—namely, first section 118 and the distal end of leg 116 of squaring arm 110—are provided with a pair of corresponding slots (not shown).

In the same manner as with slide plates 68, 70 discussed above, the slots and corresponding slide lugs 114 limit relative movement and ensure proper orientation of the squaring arm 110 with brackets 112.

The inside corner form 64 is expanded and contracted by corner form cylinder 66, which is preferably a hydraulic cylinder. The distal end of piston rod 124 is provided with a clevis 126 which receives the base 128 of squaring arm 110 between a pair of opposed members 130. Preferably a recess 132 is provided in squaring arm 110 to facilitate the position of clevis 126. A pivot pin **134*a* is received through aligned holes to couple clevis 126 to squaring arm 110. In a similar arrangement, corner form cylinder 66 is also provided with a clevis 136 which receives a forward gusset member 138. Gusset member 138 is generally triangular in shape and is welded to the interior face of corner skin plate 72. A pivot pin 134*b* is received through aligned holes to couple gusset member 138 and corner skin plate 72 to corner form cylinder 66. In operation of corner form 64, reciprocation of rod 124 moves corner skin plate 72** back and forth from the closed casting position (i.e. fully expanded) to the open release position (i.e. fully contracted) via relative movement of the slide lugs within the respective slots of both the slide plates and squaring arms and brackets.

Figure 5:
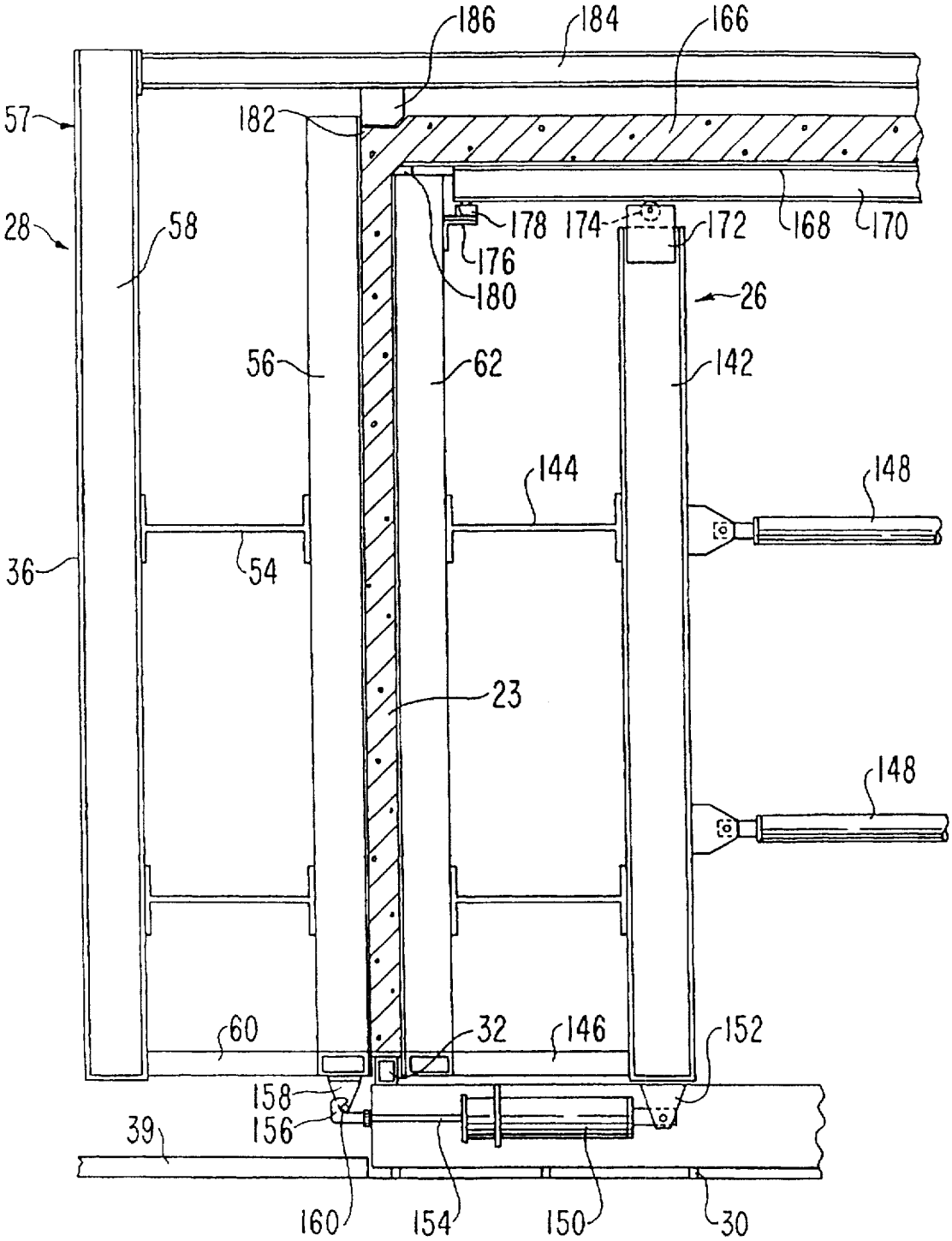
FIG. 5 is a cross-sectional view of the system taken along line 5—5 of FIG. 1.
Figure 11:
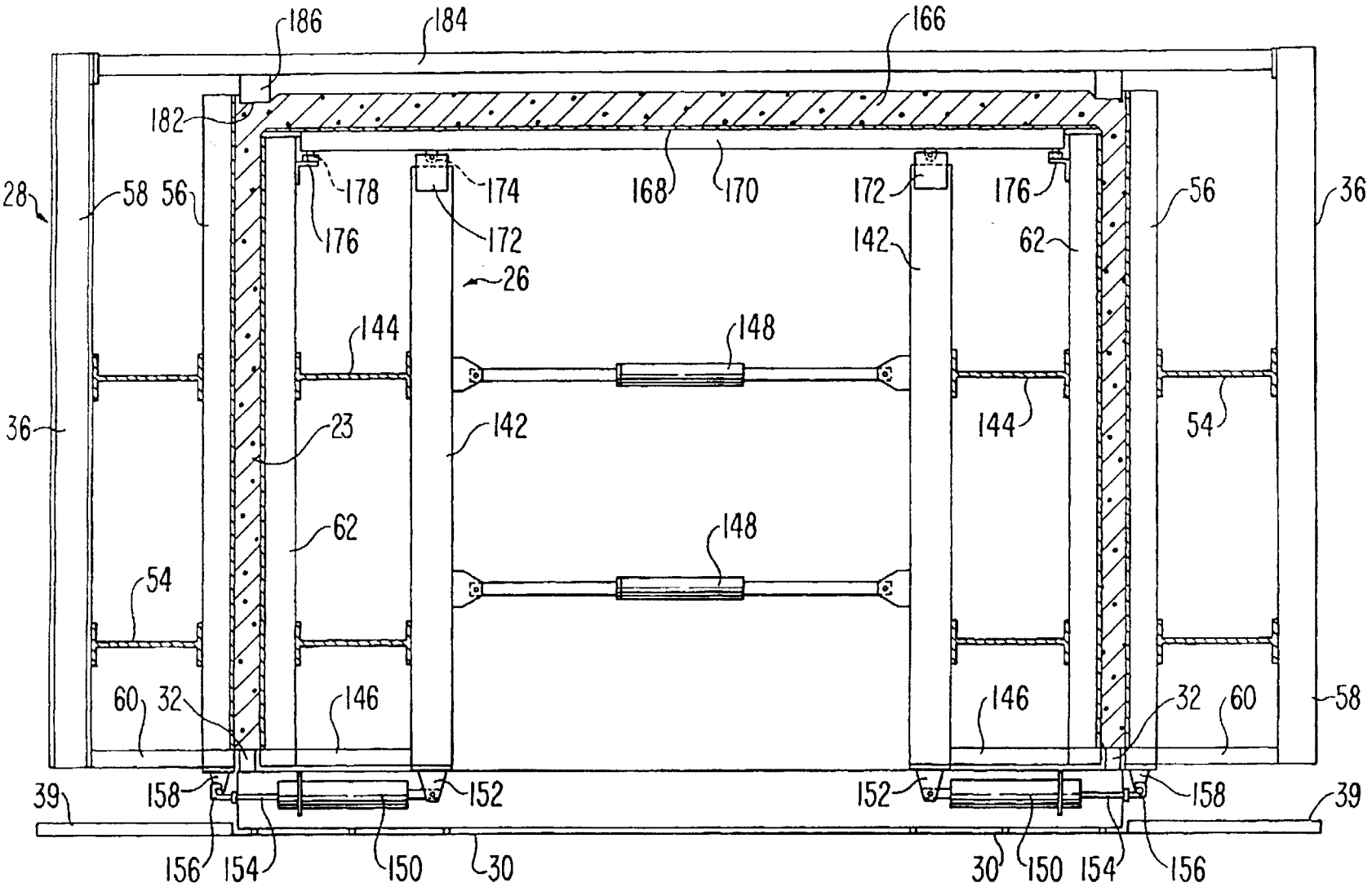
FIG. 11 is a cross-sectional cut-away view of the system taken along line 11—11 of FIG. 1 shown in the closed casting position.
Figure 12:
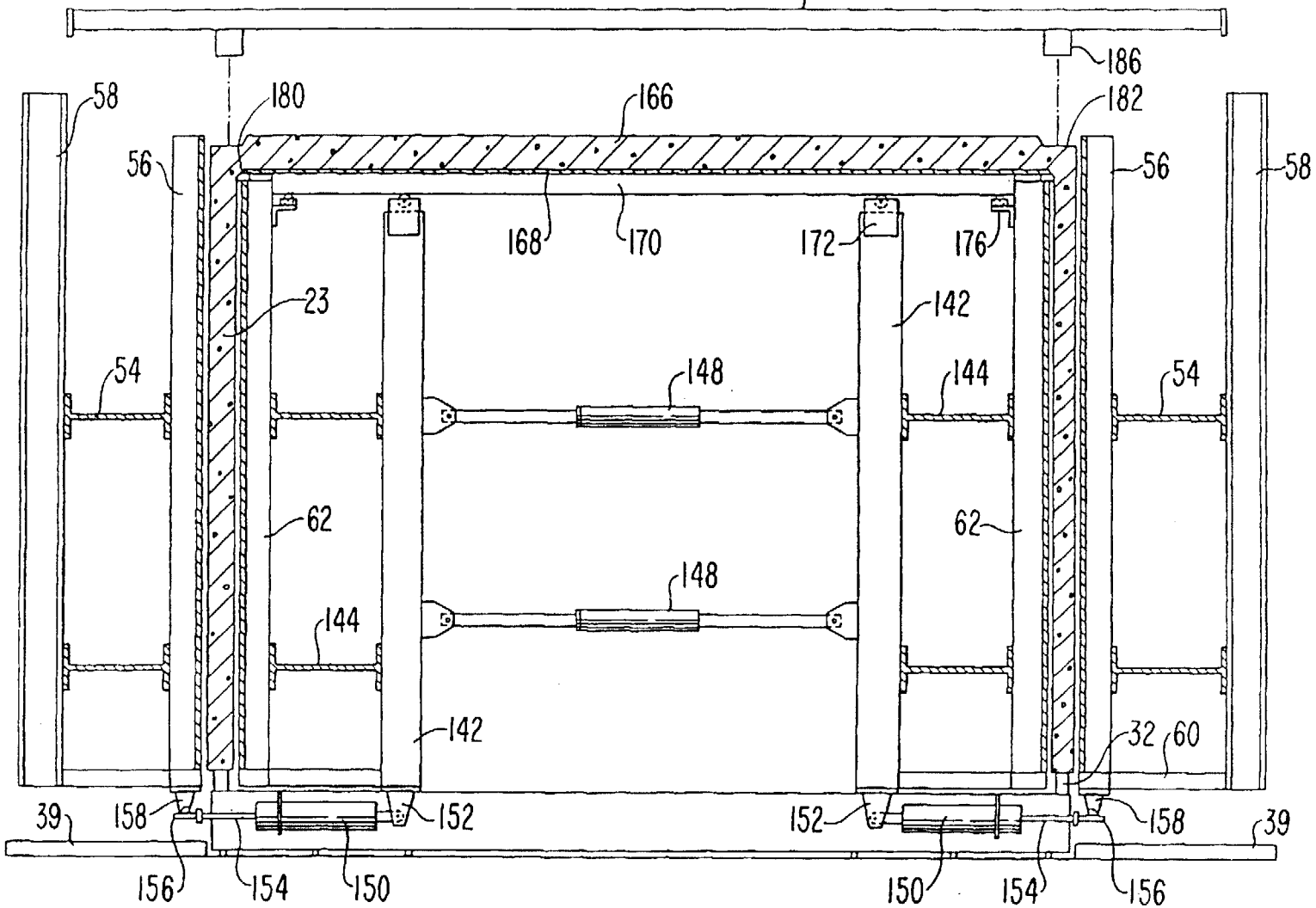
FIG. 12 is a cross-sectional cut-away view similar to FIG. 11 but shown in the open release position.

The remaining construction of inside core 26 includes interior forming panels 62 and interior columns 142 (FIGS. 5, 11 and 12). The forming panels define the four walls extending between the corners. In between interior panels 62 and columns 142 are a series of vertically spaced interior walers 144. I-beams are preferably used for interior walers 144 and columns 142. Similar to the outside jacket, near the base, interior braces 146 connect the bottoms of interior forming panels 62 to the bottoms of interior columns 142. This reinforced construction ensures the overall integrity of the mold system.

Preferably two series of middle cylinders 148, preferably hydraulic, span the middle portion of inside core 26 (FIGS. 1, 2, 5, 11 and 12). Middle cylinders 148 and their rods are affixed to opposing interior columns 142 such that reciprocation of the middle cylinders moves the opposing columns and inside panels back and forth. The middle cylinders 148 in conjunction with cylinders 66 in corner forms 64 function to expand and contract inside core 26 between the open release position and the closed casting position. Movement of each of the opposing interior panels in the preferred embodiment is approximately 13/16 of an inch. As with corner linking cylinders 50, a series of middle cylinders 148 are vertically spaced in the middle portion of inside core 26 (FIGS. 5, 11 and 12). Also similar to corner linking cylinders 50, the number of series of middle cylinders 148 may vary.

Spaced along the base of mold system 20 are a plurality of base supported linking cylinders 150 which are preferably hydraulic. Base linking cylinders 150 are fastened to the bottoms of interior columns 142 by brackets 152 such that they move with the contraction and expansion of the inner core. Base linking cylinders 150 are movably supported by appropriate framework in the base. Rods 154 of these base linking cylinders 150 each preferably has a rotating flop-gate connector 156 at its free end for selectively engaging a jacket bracket 158. Nevertheless, other adjustable connectors could be used. Each jacket bracket 158 extends downward from the bottom of an exterior forming panel 56.

Figure 8:
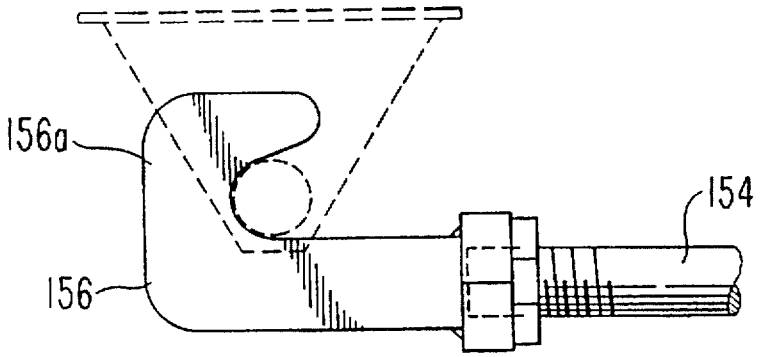
FIG. 8 is a detailed view of the flop-gate connector of FIG. 5 shown in the engaged position.
Figure 9:
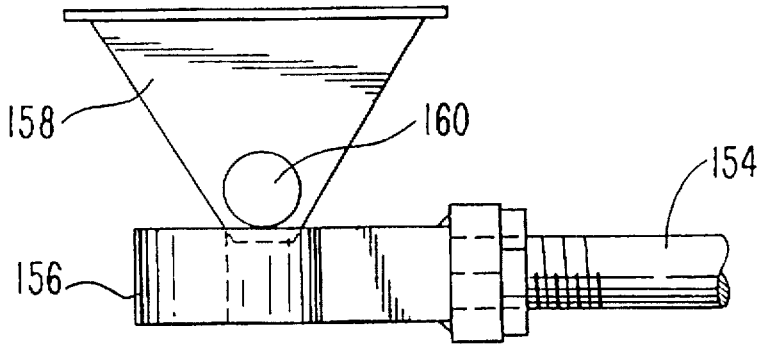
FIG. 9 is a detailed view of the flop-gate connector similar to FIG. 8 shown in the disengaged position.
Figure 10:
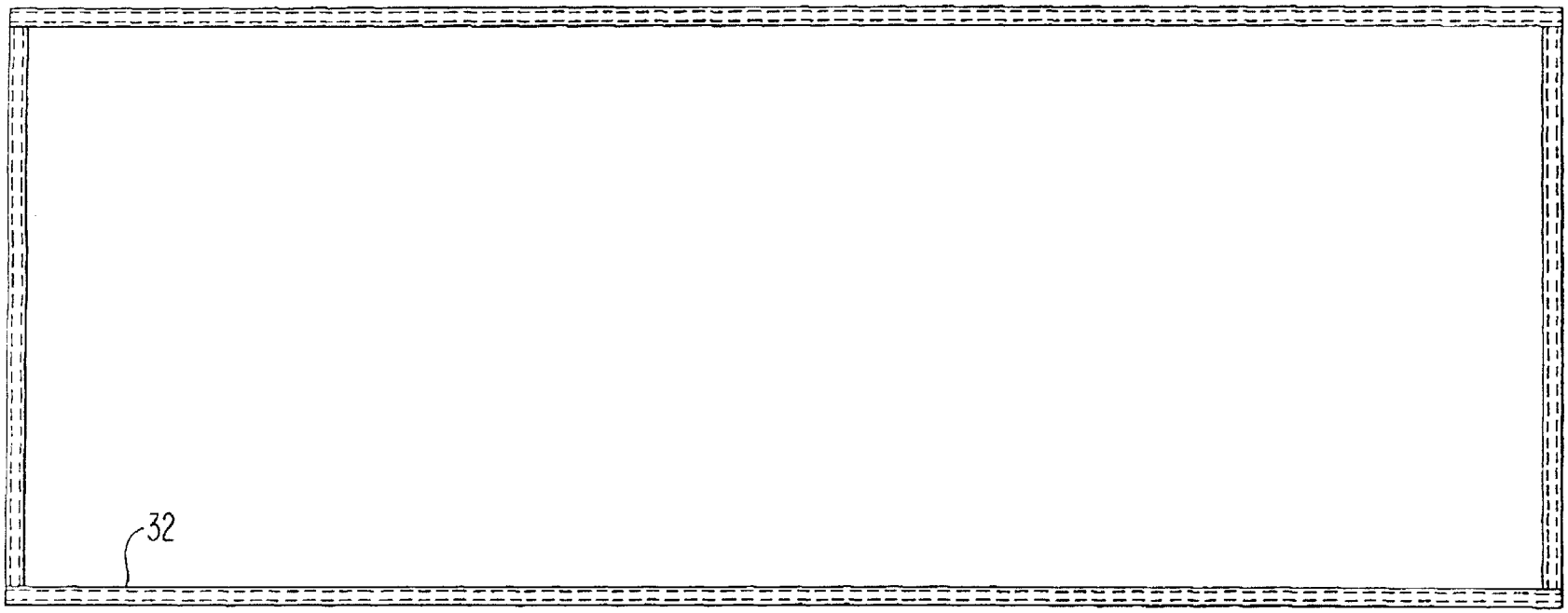
FIG. 10 is a top plan view of the pallet for the system of FIG. 1.

FIGS. 8 and 9 illustrate a flop-gate connector 156 and jacket bracket 158 in the engaged and disengaged positions. Each flop-gate connector 156 preferably has a hook **156*a* for engaging a pin 160 which extends horizontally from jacket bracket 158. To set up mold system 20 in the closed casting position, flop-gate connector 156 is rotated such that the hook 156*a* can engage pin 160. Once the connection is made, rod 154 is retracted by base linking cylinder 150 to provide a tightening or squeezing force between outside jacket 28 and inside mold core 26. When a series of base linking cylinders 150, each with its corresponding flop-gate connector 156 and jacket bracket 158, are disposed around mold system 20, the additional tightening or closing force provides an improved structural integrity which is able to alleviate unwanted grout leakage problems. Tightening or squeezing the outside jacket together with the inside mold core in this manner does not result in appreciable movement of the structure toward one another but provides increased strength to the assembly. Mold cavity 34 is reinforced by the action of base linking cylinders 150 to ensure that exterior forming panels 56 and interior forming panels 62 can withstand the pressures of the poured concrete. The number of base linking cylinders 150 used in mold system 20** will vary depending upon the size of the cast product, and other factors.

In addition to the four side walls, mold system 20 has the capacity for integrally casting a top wall or fifth side, which is referred to herein by numeral 166. Mold system 20 includes a lid 168 supported on interior panels 62 and lid support beams 170 disposed on rollers 174, 178 (FIGS. 5, 11 and 12). The opposed interior columns 142 which cooperate with middle cylinders 148 include roller bearings 172 at their top ends upon which rollers 174 are disposed. The corresponding interior panels 62 also include cantilevered roller bearings 176 having rollers 178. A number of lid support beams 170 span the space between interior panels 62 and are each supported by a roller bearing and roller arrangement. Lid 168 includes a chamfer 180 around the edges, preferably of 45°.

Figure 13A:
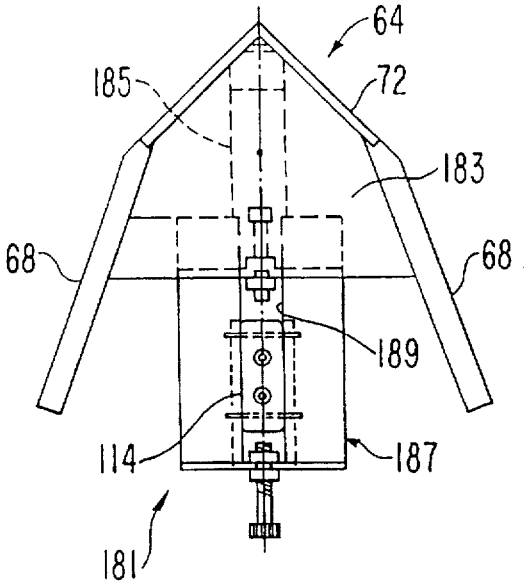
FIG. 13*a* is a detailed top plan view of a lid lug mechanism shown in conjunction with selected components of the inside corner form FIG. 3.
Figure 13B:
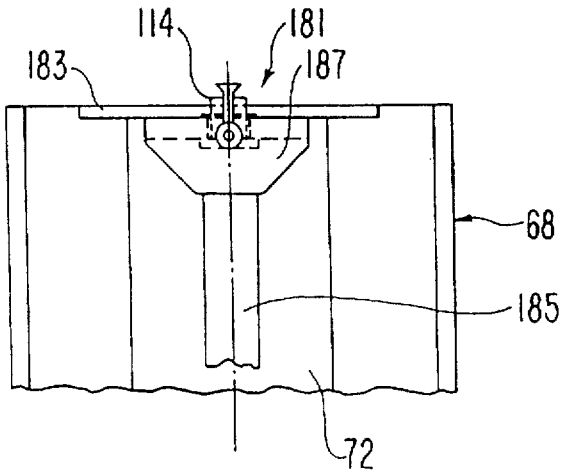
FIG. 13*b* is a frontal view of the lid lug mechanism of FIG. 13*a*.
Figure 13C:
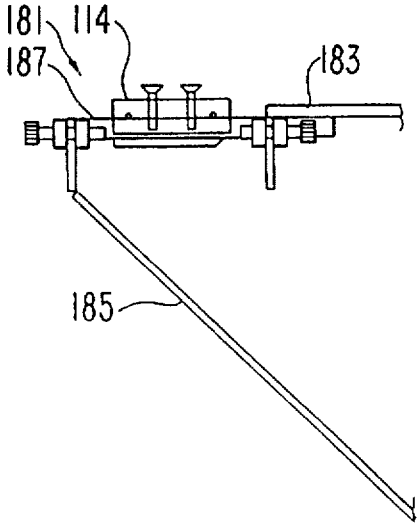
FIG. 13*c* is a side view of the lid lug mechanism of FIG. 13*a*.

In order to ensure that lid 168 remains stationary despite movement of various components of inside core 26, especially inside corner forms 64. A lid lug mechanism 181 is provided at each corner of inside core 26 (FIGS. 13a–13C). Lid lug mechanism 181 is best understood by consideration of FIGS. 3, 11 and 12. For ease of explanation, FIGS. 13a–13c illustrate a lid lug mechanism 181 in relative isolation from the components of corner form 64. Each mechanism 181 is mounted to corner skin plate 72 and inner slide plates 68 by a gusset member 183 and truss-like brace 185. A lid lug centering slide guide 187 provides a channel 189 which guides a slide lug 114 therein. As corner form 64 is retracted, slide lug 114 slides inward in channel 189 and under lid 168 which of course includes a corresponding track or guide in its undersurface (not shown) for cooperating with slide lug 114. Each lid lug mechanism 181 includes a stop mechanism to limit the extent of movement of lug 114. When lid lug mechanisms 181 are provided at each corner, inside corner forms 64 can be expanded to a desired point, and the exact extent of expansion can be repeated in subsequent operations.

For certain projects it is preferable to cast a channel-like footprint 182 in top, or fifth side 166 around the periphery of its top surface. In the cast product, footprint 182 is adapted to receive side walls 23 of a similar cast product placed thereabove or other structural features to facilitate stacking and building. Footprint 182 is also used as an absolute dimension and squaring gauge since the size of the footprints in finished products of a particular casting run should be identical. In order to form footprint 182, a beam array 184 having downwardly extending footprint molding beams 186 is placed on the poured concrete such that the molding beams correspond to the periphery of the cast product. A portion of such a beam array 184 and a molding beam is shown in FIGS. 5, 11 and 12. Beam array 184 is lowered onto the mold assembly once the concrete has been poured, and is attached to columns 58 in any suitable manner; bolts being preferred. Beam array 184 is preferably dimensioned to be 3/16 to 1/4 of an inch smaller in width and length than the space defined by exterior columns 58. In this manner, when the bolts are tightened, exterior columns 58 are pulled inward very slightly. Once the product has hardened, beam array 184 is separated from columns 58 by loosening the bolts. When the bolts are loosened, the exterior columns return to their plumb positions once again. The beam array is then hoisted away or otherwise removed from the assembly leaving behind footprint 182 in the cast product.

Figure 4:
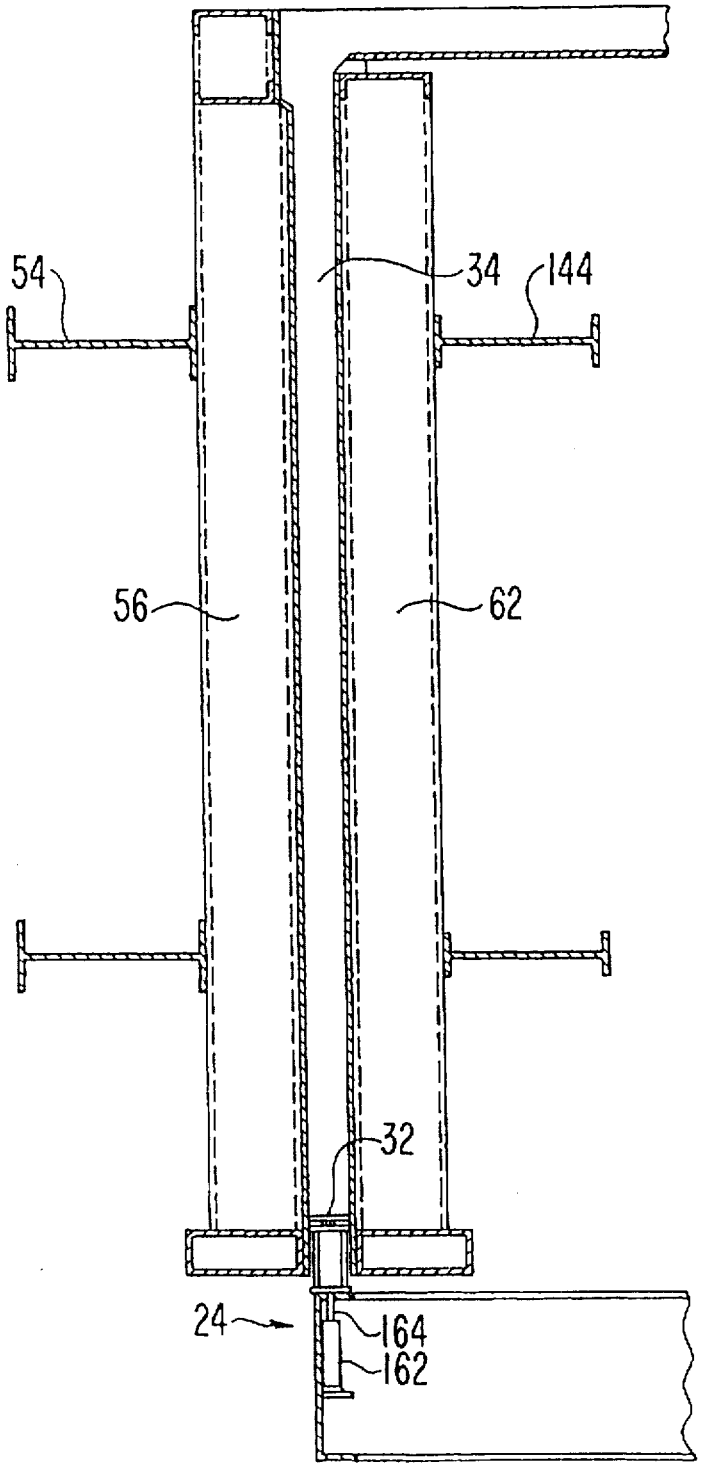
FIG. 4 is a cross-sectional view of the system taken along line 4—4 of FIG. 1 showing only the forming panels, lid and base.

Pallet cylinders 162, which are preferably hydraulic, are mounted on the base such that their rods 164 are attached to pallet 32 on their free ends. An example of a pallet cylinder is best shown in FIG. 4. Pallet 32 forms the base for receiving the poured concrete. When pallet 32 is lowered to the base for casting, pallet cylinder rods 164 preferably are retracted into cylinders 162 to their bottom-out points. During the set-up and casting process, the pallet cylinders remain in the bottomed-out position. When the system is actuated to move to its casting position, the outer and inner panels are pressed against the sides of the pallet. Once the cast product has hardened and the inner and outer panels retracted, the pallet cylinders are actuated to raise the cast product and strip top, or fifth side 166 from the lid 168.

To set up the mold system for casting, base 24 is secured and leveled by adjusting leveling screws 30. Pallet 32 is lowered to the base by retraction of pallet cylinder rods 164 into pallet cylinders 162. Inside core 26 is then expanded to its fullest extent by simultaneous expansion of middle cylinders 148 and corner form cylinders 66 so that interior panels 62 and corner plates 72 of inside corner forms 64 abut the interior surfaces of pallet 32. The lid lug mechanisms 181 enable the inside corner forms to contract and expand to an exact point, while maintaining lid 168 in a stationary position. In this way, the exact movement of the inside corner forms can be repeated in each subsequent operation. The fully expanded condition of the inside core cylinders preferably corresponds to their closed casting position. When inside core 26 is in its closed casting position, the edges of lid 168 are in alignment with interior panels 62. At the same time as the inside core 26 is expanded, outside jacket 28 is closed by moving panel members 36 inward by contraction of corner base cylinders 40. The panel members 36 are moved together until exterior forming panels 56 abut the outer surface of pallet 32. The cylinders 40, 58 and 66 are preferably all fed from the same source and at the same time such that the hydraulic fluid travels to the points of least resistance. The corner latches 48 are then latched and corner linking cylinders 50 retracted to tighten the latched relationship of the panel members. Base linking cylinders 150 are placed in engagement with jacket brackets 158. Once the connection is made, linking cylinders 150 are contracted to tighten the relationship of inside core 26 to outside jacket 28. Although only nominal movement may result from contraction of linking cylinders 50, 150, their squeezing force enhances the integrity of the overall system and alleviates grout leaks. Mold cavity 34 is now defined between exterior panels 56 and interior panels 62 for receiving the poured concrete.

The concrete is then poured into the mold cavity 62. If only four sides are desired, the concrete is stopped before the top of panels 62 are reached. If a five-sided product is desired, then concrete is also poured over lid 168. After the concrete is poured or pumped into mold cavity 34, hooks may be added by conventional means to top, or fifth side 166 for use in later removing cast product 22 from mold system. If desired, top beam array 184 is hoisted into place with molding beams 186 positioned to form footprint 182 on top, or fifth side 166.

The beam array is connected to exterior columns 58, and the concrete allowed to harden.

Stripping cast product 22 from mold system 20 is accomplished by performing the operations explained above in the reverse order. An advantageous feature of the present invention concerns the function of the flop-gate connector during the stripping operation. When the cast is complete, each flop-gate connector 156 is disengaged from its respective jacket bracket 158 by a slight expansion of linking cylinder rod 154. The flop-gate connector can then be rotated so that contact with jacket bracket 158 can be avoided when jacket panel members 36 are moved outward by expansion of corner base cylinders 40. Another advantageous feature of the invention concerns stripping top, or fifth side 166 from lid 168. When beam array 184 has been removed and the components of mold system 20 are in the open release position, corner base cylinders 40 are expanded to push jackets 54 outward. The upward movement of pallet 32 by cylinder 162, and thus cast product 22, strips the underside of the top, or fifth side 166 from lid 168. The casting can then be removed from mold system 20 by hoisting using conventional hardware such as cables or inserted hooks, and the mold system can be easily set up to perform the operation again.

All of the cylinders in the preferred embodiment are tied to a single fluid source and controlled in a known manner by a four section stack valve. The single power source is used to drive the corner base cylinders 40, corner form cylinders 66, and middle cylinders 148 so that the hydraulic fluid flows to the places of least resistance in expanding and contracting the mold forms. This construction prevents binding problems between interacting sets of cylinders. It is contemplated that multiple power sources and corresponding control system may also be used. In addition, all of the cylinders may be designed or adjusted to "bottom-out" at either end of the stroke in order to insure consistency in the length of expansion and contraction.

The above description is that of a preferred embodiment of the invention. Various alterations and changes can be made without departing from the spirit and broader aspects of the invention as set forth in the appended claims.

We claim:

1. An apparatus for integrally casting a five-sided monolithically poured concrete module having a plurality of side walls and an end wall, comprising:

a pallet including pallet members collectively defining the cross-sectional shape of the side walls, the thickness of each said pallet member corresponding to the thickness of the side walls of the concrete module;

an inside mold core disposed within said pallet comprising a plurality of interior panels and corner forms for molding inside surfaces of the side walls;

means for moving said interior panels and said corner forms between a closed casting position and an open release position, said inside mold core abutting against said pallet in said closed casting position;

an outside jacket disposed outside of said pallet comprising two L-shaped panel members cooperatively arranged to generally envelope said pallet and inside mold core, said panel members comprising exterior panels for molding outside surfaces of the side walls;

means for moving said L-shaped panel members between a closed casting position and an open release position, said outside jacket abutting against the pallet in said closed casting position, said inside mold core and said outside jacket defining a mold cavity therebetween for receiving the concrete in said closed casting position;

a lid overlying said inside mold core for molding the inside surface of the end wall; and means for linking said inside mold core to said outside jacket and providing an increased closing force during casting to strengthen said interior panels and said exterior panels defining said mold cavity.

2. The apparatus of claim 1 which further includes a plurality of rollers disposed at the top of said inside mold core for supporting said lid thereon, wherein said lid includes means for guiding said rollers when said interior panels are moved, said guiding means includes stops to ensure that said lid is properly positioned.

3. The apparatus of claim 1 which further includes a fixed base and wherein said means for moving said exterior panels comprises a corner base fluid cylinder fastened to the fixed base and to the apex of each said L-shaped panel member.

4. The apparatus of claim 1 wherein said outside jacket further comprises corner linking fluid cylinders and cooperating corner latches, wherein said corner linking cylinders and said corner latches link adjacent ends of said L-shaped panel members, and wherein said corner linking cylinders are actuated to tighten and strengthen said outside jacket at diagonally opposing corners to ensure against leakage.

5. The apparatus of claim 1 wherein each said inside corner form comprises a central corner member for forming and shaping the inside corner of the product, and said means for moving said interior panels comprises a fluid middle cylinder disposed between opposing ones of said interior panels such that reciprocation of said middle cylinder results in movement of said opposing ones of said interior panels, and said means for moving said inside corner form comprises an inner corner cylinder coupled with said central corner member to reciprocate said central corner member between an expanded casting position and a retracted release position, and wherein said middle cylinder and said inner corner cylinder cooperatively expand into the closed casting position, and said middle cylinder and said inner corner cylinder cooperatively retract into the open release position.

6. The apparatus of claim 1 wherein said means for linking said inside mold core and said outside jacket comprises a series of fluid base linking cylinders fastened to and arranged in spaced intervals along said inside mold core and a series of jacket brackets fastened to and arranged in correspondingly spaced intervals along said outside jacket, each said base linking cylinder having an adjustable connector for selectively engaging a corresponding one of said jacket brackets, wherein when said inside mold core and said outside jacket are in the closed casting position each of said connectors is engaged to said corresponding one of said jacket brackets and said base linking cylinders are actuated to provide increased closing force during casting.

7. The apparatus of claim 1 further comprising a base and a fluid pallet cylinder in the base for lowering said pallet to the base prior to casting, and for raising said pallet to release the end wall of the module from said lid.

8. A mold system for integrally casting a monolithic concrete product having a plurality of walls and an internal cavity, comprising:

a mold core and a jacket defining therebetween a mold cavity for receiving concrete, said mold core including a plurality of interior panels for molding the inside surfaces of the walls of the concrete product, said jacket including a plurality of exterior panels for molding the outside surfaces of the walls;

interior actuators engaging and moving said interior panels of said mold core between a closed casting position and an open release position;

exterior actuators engaging and moving said exterior panels of said jacket between a closed casting position and an open release position; and linking actuators spanning said mold cavity and engaging said mold core and said jacket and providing an increased closing force during casting to strengthen said interior panels and said exterior panels of said mold cavity.

9. The mold system of claim 8 wherein said linking actuators are fastened to one of said mold core and said jacket for movement therewith and selectively engaged with the other of said mold core and said jacket.

10. The mold system of claim 8 wherein said jacket comprises two L-shaped panel members arranged in a generally rectangular configuration and corner latch assemblies to connect said panel members at diagonally opposing corners of said mold cavity.

11. The mold system of claim 10 which further comprises a fixed base and wherein said exterior actuators are fastened to the fixed base and the apex of each of said L-shaped panel members such that operation of said exterior actuators results in movement of said exterior panel members.

12. The mold system of claim 10 wherein said jacket corner latch assemblies comprise corner actuators to tighten and strengthen said jacket at said diagonally opposing corners to alleviate grout leakage.

13. The mold system of claim 8 wherein said mold core further includes a plurality of inside corner forms interconnecting said interior panels, each said inside corner form comprises a corner member for forming and shaping the inside corner of the product and an actuator coupled to said corner member to reciprocate said corner member between an expanded casting position and a retracted release position, and wherein said interior actuators and said corner form actuators cooperatively operate to expand said mold core into the closed casting position and to retract said mold core into the open release position.

14. The mold system of claim 13 in which said interior actuators and said corner form actuators are fluid cylinders.

15. The mold system of claim 8 wherein said jacket includes a plurality of brackets and said linking actuators include adjustable connectors which selectively engage a corresponding one of said brackets to squeeze said interior and exterior panels toward one another.

16. The mold system of claim 8 which further includes a lid for molding the inside surface of an end wall of the cast product.

17. The mold system of claim 16 which further comprises a pallet positioned between said interior and exterior panels and defining a base for the mold cavity, and pallet actuators which engage and lift said pallet and thereby strip the cast product from said lid.

18. The mold system of claim 8 wherein said interior actuators, said exterior actuators and said linking actuators are fluid cylinders.

19. A mold system for integrally casting a monolithic concrete product having a plurality of side walls, an end wall and an internal cavity comprising:

a mold core and a jacket defining therebetween a mold cavity for receiving concrete, said mold core including a plurality of interior panels for molding the inside surfaces of the side walls of the concrete product, said jacket including a plurality of exterior panels for molding the outside surfaces of the side walls.

interior actuators engaging and moving said interior panels of said mold core between a closed casting position and an open release position;

exterior actuators engaging and moving said exterior panels of said jacket between a closed casting position and an open release position;

linking actuators linking said jacket to said mold core;

a lid for molding the inside surface of the end wall of the cast product;

a pallet positioned between said interior and exterior panels and defining a base for the mold cavity; and pallet actuators engaging and lifting said pallet to thereby strip the cast product from said lid.

20. The mold system of claim 8 which further includes a pallet positioned between said interior and exterior panels and defining a base for the mold cavity.

21. The mold system of claim 16 which further includes plurality of rollers disposed at the top of said inside mold core for supporting said lid thereon, wherein said lid includes guides which direct said rollers when said interior panels are moved to ensure that said lid is properly positioned.

* * * * *